US005904600A

United States Patent [19]

Tomita et al.

[11] Patent Number: 5,904,600

[45] Date of Patent: May 18, 1999

[54] CLAMP-TYPE TERMINAL

[75] Inventors: Yoshinori Tomita; Naomi Suzuki, both of Shizuoka, Japan

[73] Assignee: Yazaki Corporation, Tokyo, Japan

[21] Appl. No.: 09/008,066

[22] Filed: Jan. 16, 1998

[30] Foreign Application Priority Data

Jan. 17, 1997 [JP] Japan ..... 9-006666

[51] Int. Cl.[6] ..... H01R 4/10

[52] U.S. Cl. ..... 439/877

[58] Field of Search ..... 439/877, 595

[56] References Cited

U.S. PATENT DOCUMENTS 5,516,311 5/1996 Maejima ..... 439/877

FOREIGN PATENT DOCUMENTS 55-7235 1/1980 Japan ..... H01R 4/18

*Primary Examiner*—Neil Abrams
*Assistant Examiner*—Briggitte R. Hammond
*Attorney, Agent, or Firm*—Sughrue, Mion, Zinn, Macpeak & Seas, PLLC

[57] ABSTRACT

A clamp-type terminal including a connection portion for a mating terminal, a conductor clamping portion for clamping a conductor of a wire, a sheath clamping portion for clamping a sheath of the wire, and a base portion integrally connecting the connection portion, the conductor clamping portion and the sheath clamping portion together. A bending portion is bendably formed on the connection portion, and is bent at least toward a front end portion of the conductor, clamped by the conductor clamping portion, so as to prevent the front end portion of the conductor from being deflected upwardly. Further, notches are provided adjacent to the bending portion so as to make it possible to confirm the clamping of the conductor by the conductor clamping portion.

3 Claims, 7 Drawing Sheets

CLAMP-TYPE TERMINAL

BACKGROUND OF THE INVENTION

1. Field of the Invention

This invention relates to a clamp-type terminal to be clamped to an end of a wire used, for example, in an electric system of a vehicle.

2. Description of the Related Art

When clamping a clamp-type terminal to a wire, it is necessary that an end of the wire should be extended outwardly from a conductor clamping portion of the clamp-type terminal so that the sufficient contact of the wire conductor with the conductor clamping portion can be confirmed. However, the conductor end, extending outwardly from the clamping portion, is liable to be curved outwardly to be deflected upwardly.

FIGS. 5 to 7 show a conventional clamp-type terminal 1, disclosed in Japanese Utility Model Unexamined Publication No. Sho. 55-7235, in which the upward deflection of a conductor end is prevented. FIG. 8 shows a conventional clamp-type terminal 3 in which the upward deflection of a conductor end is prevented, and also the contact of the conductor with the terminal can be confirmed.

As shown in FIG. 5, the clamp-type terminal 1 includes a connection portion 5 for a mating terminal, a conductor clamping portion 11 for clamping a conductor 9 of a wire 7, a sheath clamping portion 15 for clamping a sheath 13 of the wire 7, and a base portion integrally connecting these portions together.

As shown in FIGS. 6 and 7, a front end portion 17 of the conductor clamping portion 11, disposed at a front end of the conductor 9, is crushed to be sealed, and with this construction, the front end portion of the conductor 9 is isolated from the ambient atmosphere, and also this front end portion is prevented from being deflected upwardly.

However, when the front end portion 17 of the conductor clamping portion 11 is thus crushed, the front end of the conductor 9 is not extended to an area 19 shown in FIG. 5, and therefore it is impossible to confirm whether the front end of the conductor 9 is held in sufficient contact with the conductor clamping portion 11 as shown in FIG. 6 or is held in insufficient contact with the conductor clamping portion 11 such that a gap 21 is formed between the front end of the conductor 9 and the conductor clamping portion 11 as shown in FIG. 7.

On the other hand, as shown in FIG. 8, the clamp-type terminal 3 includes a connection portion 23 for a mating terminal, a deflection prevention portion 25 for preventing upward deflection of a conductor of a wire, a conductor clamping portion 27 for clamping the conductor, a sheath clamping portion 29 for clamping a sheath of the wire, notches 31 for enabling the confirmation of a clamped condition of the conductor, and a base portion integrally connecting these portions together.

For clamping the wire to the clamp-type terminal 3, a front end portion of the wire is inserted into the deflection prevention portion 25, and the conductor of the wire is clamped by the conductor clamping portion 27 while the sheath of the wire is clamped by the sheath clamping portion 29.

In the clamp-type terminal 3, the upward deflection of the conductor is prevented by the deflection prevention portion 25, and also the clamped condition of the conductor can be confirmed through the notches 31.

In the clamp-type terminal 3, however, the deflection prevention portion 25 is formed into a narrow tube so as to prevent the upward deflection of the conductor, and it is quite difficult to insert the conductor of the wire into the deflection prevention portion 25 regardless of whether the clamping operation of the clamp-type terminal 3 is effected automatically or manually.

Therefore, the manual operation requires much time, and this increases the cost. In the automatic operation, there is a possibility that the conductor end fails to be inserted into the deflection prevention portion 25, or part of the conductor end is not inserted into the deflection prevention portion 25, but is laid thereon, and in this condition the clamping operation is effected. Thus, frequently, the upward deflection of the conductor can not be prevented, or the clamping operation is effected in such a manner that the clamp-type terminal 3 is inclined relative to the wire.

SUMMARY OF THE INVENTION

With the above problems in view, it is an object of this invention to provide a clamp-type terminal in which with a simple clamping operation, the function of confirming the contact between a conductor and a clamping portion, as well as the function of preventing upward deflection of the conductor, can be obtained.

According to the present invention, there is provided a clamp-type terminal comprising: a connection portion for a mating terminal; a conductor clamping portion for clamping a conductor of a wire; a sheath clamping portion for clamping a sheath of the wire; a base portion integrally connecting the connection portion, the conductor clamping portion and the sheath clamping portion together; a bending portion bendably formed on the connection portion to be bent at least toward a front end portion of the conductor which has been clamped by the conductor clamping portion, so as to prevent the front end portion of the conductor from being deflected upwardly; and a notch provided adjacent to the bending portion so as to make it possible to confirm the clamping of the conductor by the conductor clamping portion.

DETAILED DESCRIPTION OF THE PREFERRED EMBODIMENT

A preferred embodiment of the present invention will now be described with reference to FIGS. 1 to 4.

Figure 1:
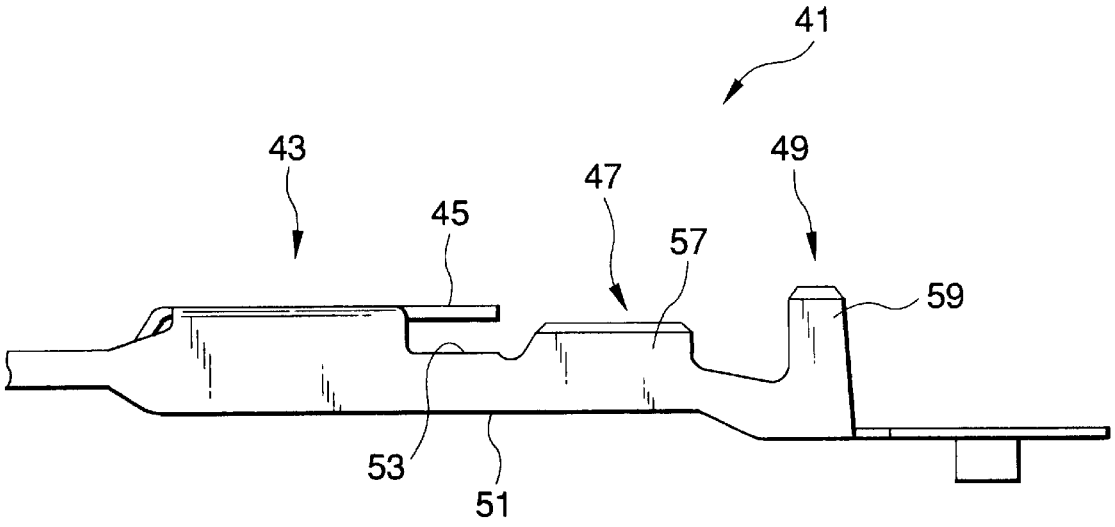
FIG. 1 is a side-elevational view of a preferred embodiment of clamp-type terminal of the present invention.
Figure 2:
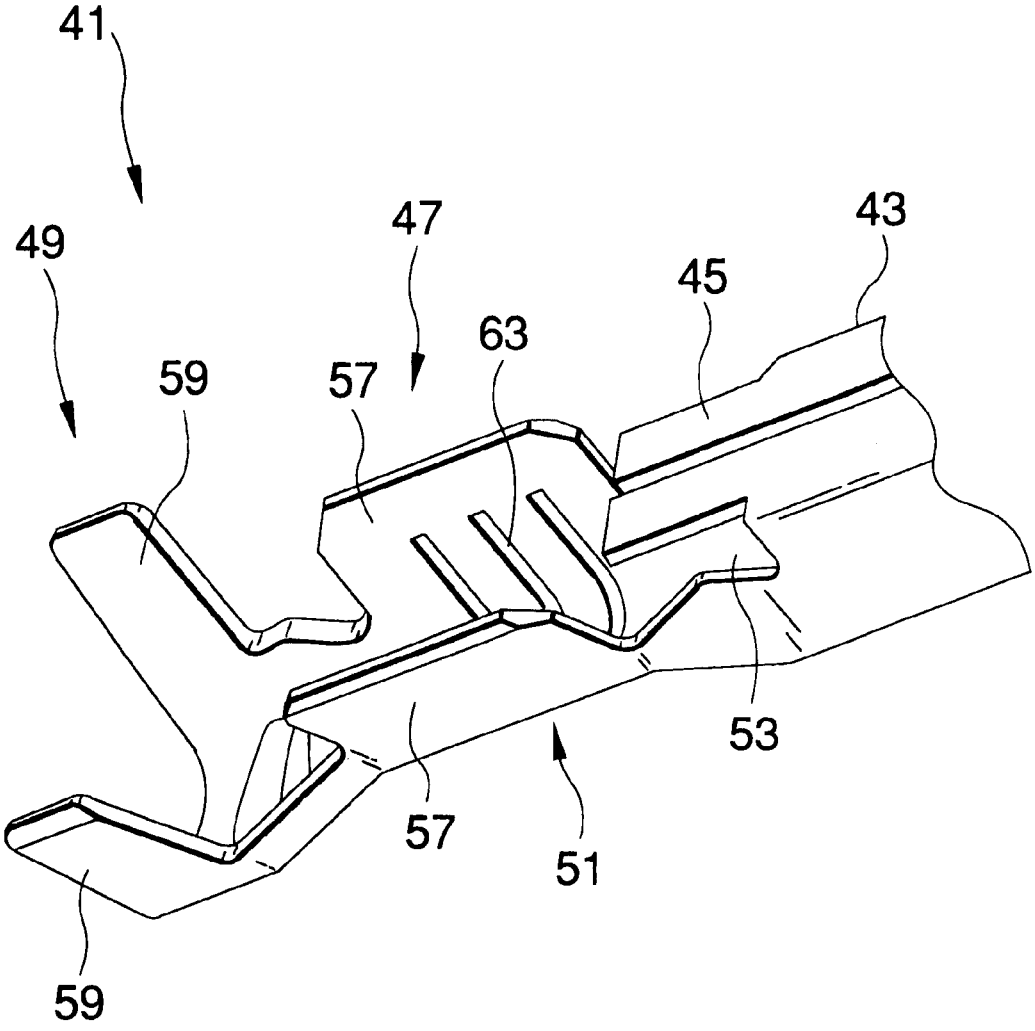
FIG. 2 is a perspective view of the clamp-type terminal of FIG. 1.
Figure 3:
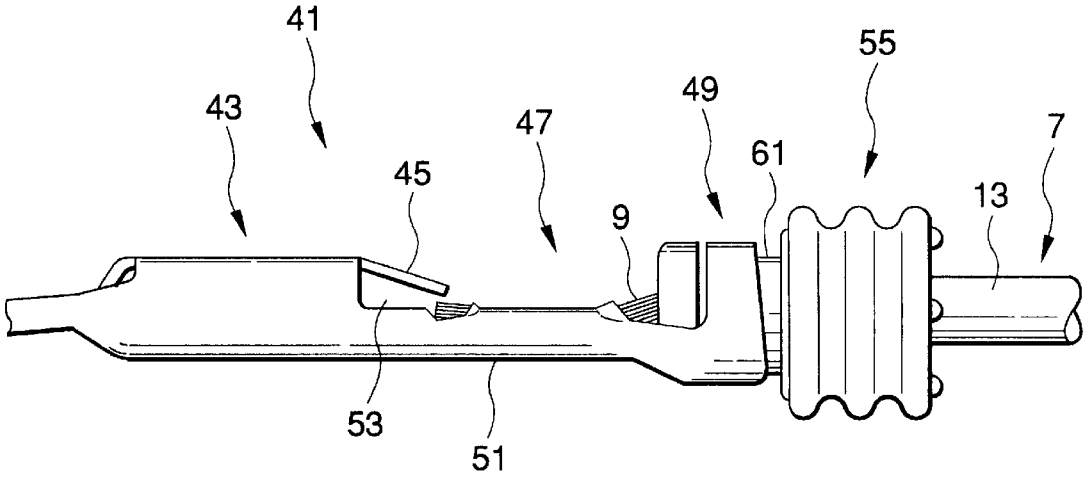
FIG. 3 is a side-elevational view showing a condition in which the clamp-type terminal of FIG. 1 is clamped to a wire.
Figure 4:
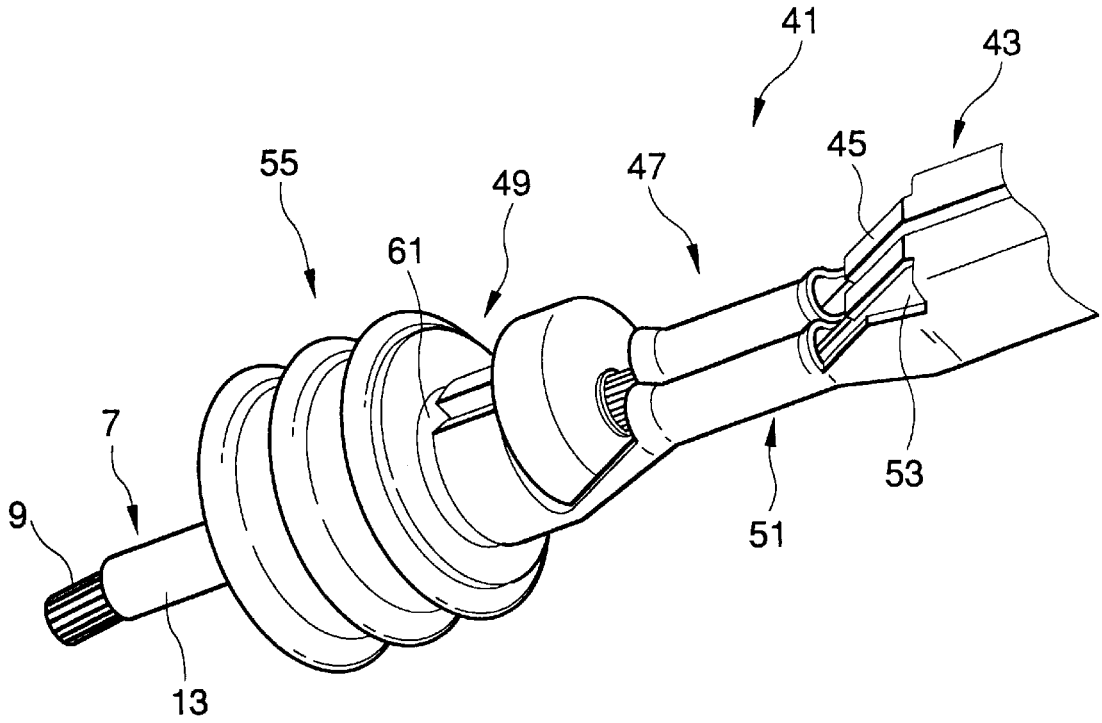
FIG. 4 is a perspective view of the clamp-type terminal of FIG. 1 clamped to the wire.
Figure 5:
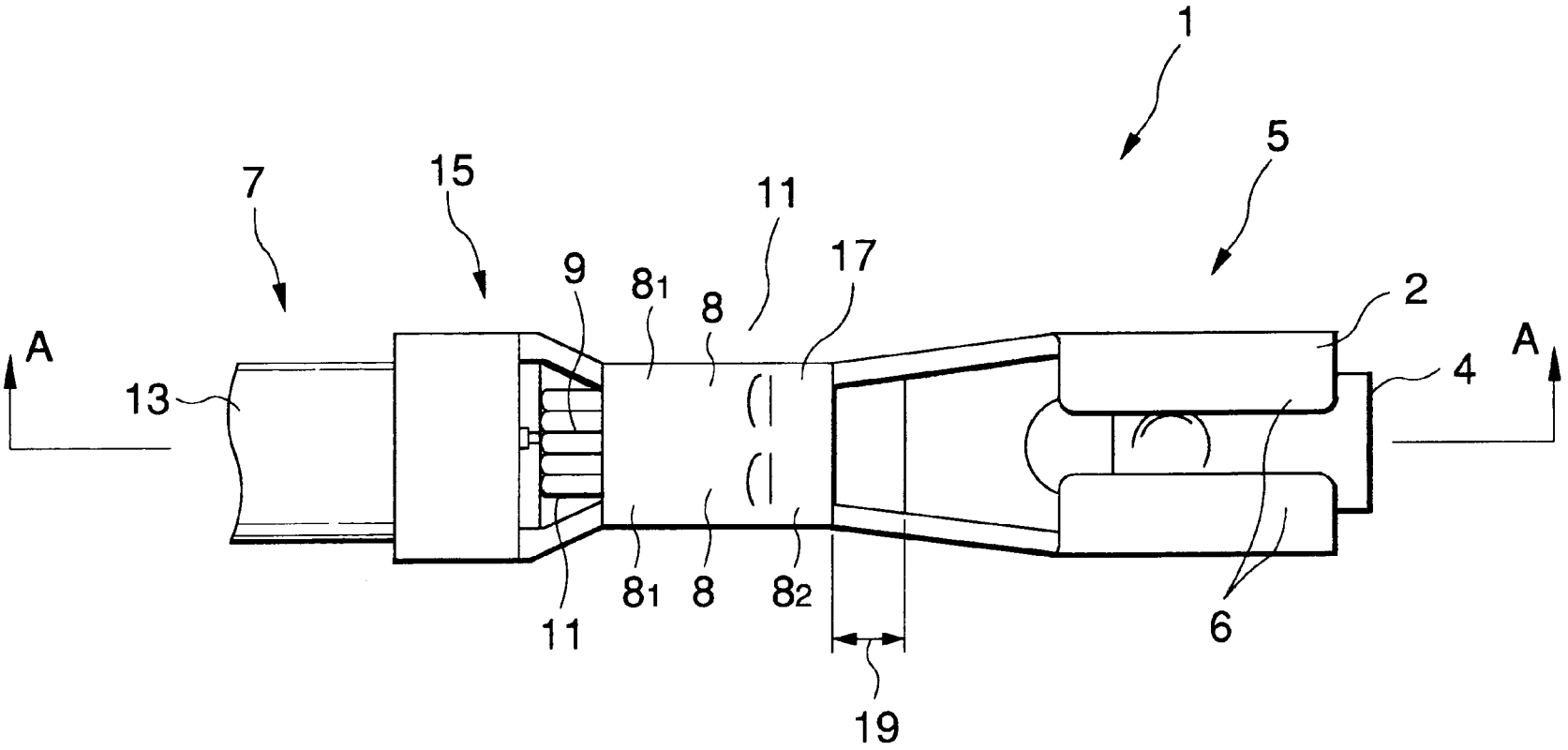
FIG.5 PRIOR ART
FIG. 5 is a front-elevational view of a conventional clamp-type terminal.
Figure 6:
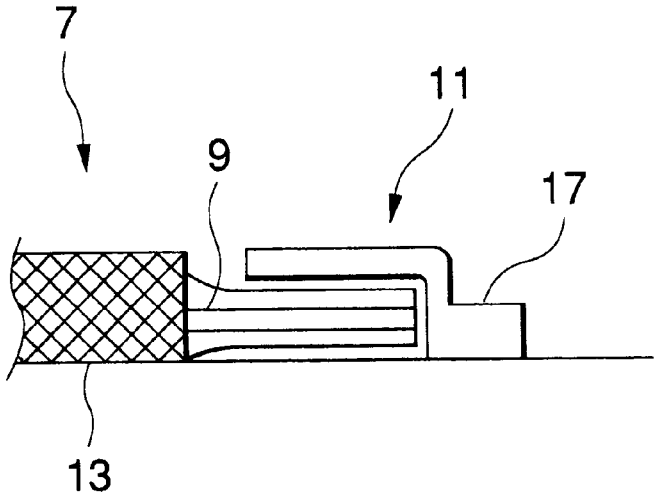
FIG.6 PRIOR ART
FIG. 6 is a cross-sectional view taken along the line A—A of FIG. 5, showing a condition in which a conductor of a wire is held in sufficient contact with a conductor clamping portion.
Figure 7:
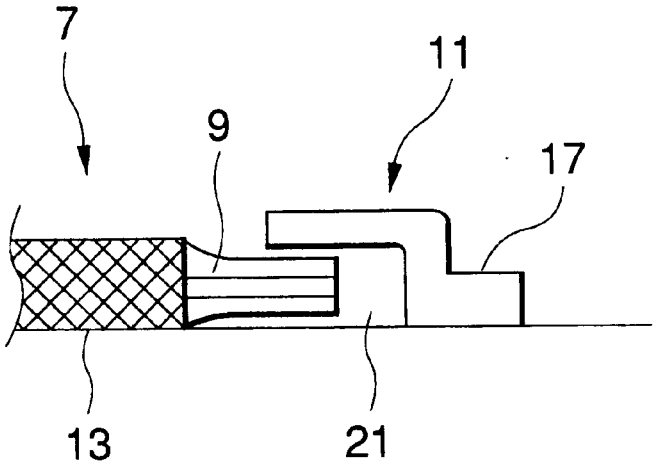
FIG.7 PRIOR ART
FIG. 7 is a cross-sectional view taken along the line A—A of FIG. 5, showing a condition in which the conductor of the wire is held in insufficient contact with the conductor clamping portion.
Figure 8:
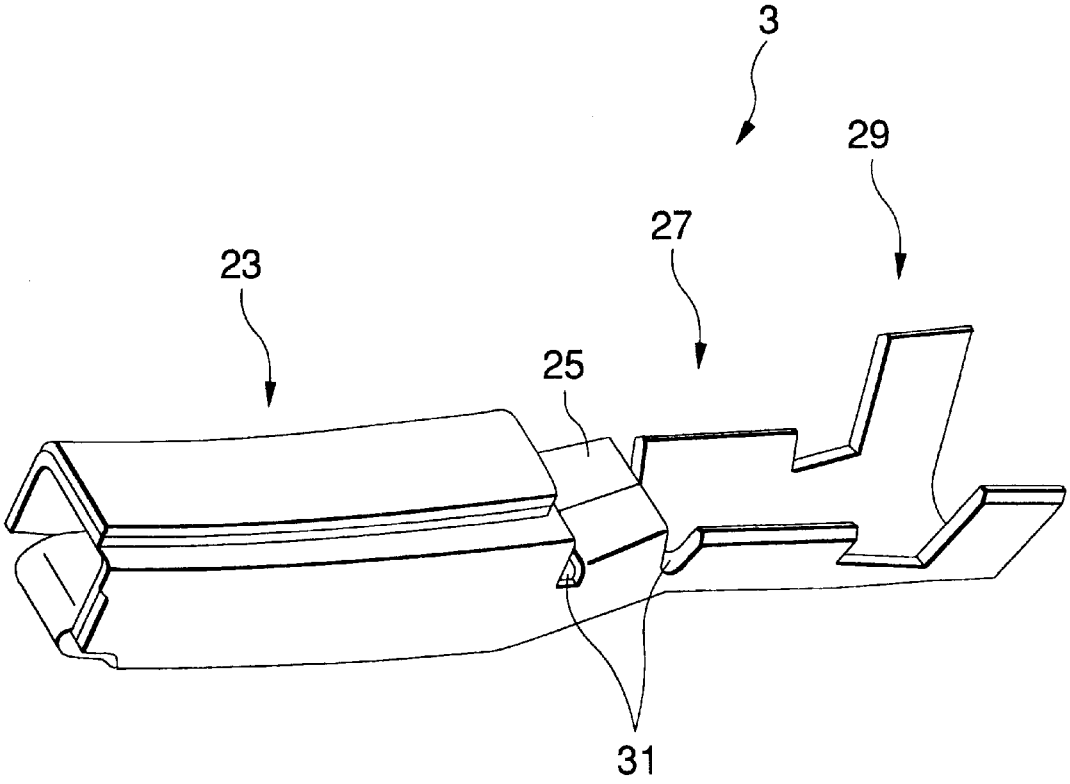
FIG.8 PRIOR ART
FIG. 8 is a perspective view of another conventional clamp-type terminal.

FIG. 1 is a side-elevational view of a clamp-type terminal 41 of this embodiment, showing a condition before it is clamped, FIG. 2 is a perspective view of this terminal, FIG. 3 is a side-elevational view showing a condition in which the clamp-type terminal 41 is clamped to a wire 7, and FIG. 4 is a perspective view of the clamp-type terminal clamped to the wire.

As shown in FIGS. 1 and 2, the clamp-type terminal 41 includes a connection portion 43 for a mating terminal, a bending portion 45 formed on this connection portion 43 in a cantilever manner, a conductor clamping portion 47 for clamping a conductor 9 of the wire 7, a sheath clamping portion 49 for clamping a sheath 13 of the wire 7, a base portion 51 integrally connecting these portions together, and notches 53 formed between the bending portion 45 and the base portion 51.

As shown in FIGS. 3 and 4, a rubber plug 55 is mounted on an end portion of the wire 7. This rubber plug 55 shuts off the ambient atmosphere and moisture when the clamp-type terminal 41 and the wire 7 are inserted into a connector.

As shown in FIG. 2, the conductor clamping portion 47 comprises a pair of clamping piece portions 57 formed respectively on opposite sides of the base portion 51, and similarly the sheath clamping portion 49 comprises a pair of clamping piece portions 59 formed respectively on the opposite sides of the base portion 51. A distal end of each of the clamping piece portions 57 is formed into an edge-like shape so that it can bite the conductor 9, and similarly a distal end of each of the clamping piece portions 59 is formed into an edge-like shape so that it can bite a smaller-diameter portion 61 of the rubber plug 55. Three narrow recesses 63 are formed in an inner surface of the conductor clamping portion 47 so that it can satisfactorily bite the conductor 9.

The clamp-type terminal 41 has such a construction.

For clamping the clamp-type terminal 41 to the wire 7, the smaller-diameter portion 61 of the rubber plug 55, mounted on the end portion of the wire 7, is placed on the sheath clamping portion 49, and a front end portion of the conductor 9 is placed on the conductor clamping portion 47, as shown in FIG. 3. At this time, the front end of the conductor 9 is slightly projected from the conductor clamping portion 47 toward the bending portion 45.

In this condition, the clamping piece portions 57 of the conductor clamping portion 47 are pressed against the conductor 9, and the clamping piece portions 59 of the sheath clamping portion 49 are pressed against the smaller-diameter portion 61 of the rubber plug 55, and further the bending portion 45 is bent toward the front end portion of the conductor 9.

By thus bending the bending portion 45 toward the front end portion of the conductor 9, the upward deflection of the front end portion of the conductor 9 is prevented. The notches 53 are provided adjacent to the bending portion 45, and therefore after the clamping operation, it can be confirmed whether or not the conductor 9 is held in sufficient contact with the conductor clamping portion 47.

The bending portion 45 is not bent before the clamping operation of the wire 7, and therefore as compared with the conventional construction in which the conductor is inserted into the narrow, tubular deflection prevention portion 25, the mounting operation of the wire 7 in the clamp-type terminal 41 is much easier, and the efficiency of the operation is greatly enhanced regardless of whether the clamping operation is effected automatically or manually, and therefore the cost for the operation can be reduced.

In the clamp-type terminal of the present invention, the bending portion is formed on the connection portion for the mating terminal, and by bending this bending portion toward the front end portion of the conductor, the upward deflection of the front end portion of the conductor can be prevented.

Since the notches are provided adjacent to the bending portion, it can be confirmed whether or not the conductor is held in sufficient contact with the conductor clamping portion.

Besides, since the bending portion is not bent before the clamping operation of the wire, the mounting operation of the wire in the clamp-type terminal is much easier as compared with the conventional construction, and the operation efficiency and the operation cost can be greatly improved.

What is claimed is:

1. A clamp-type terminal comprising:

a connection portion for a mating terminal;

a conductor clamping portion for clamping a conductor of a wire;

a sheath clamping portion for clamping a sheath of the wire;

a base portion integrally connecting said connection portion, said conductor clamping portion and said sheath clamping portion together;

a bending portion bendably formed on said connection portion to be bent at least toward a front end portion of the conductor which has been clamped by said conductor clamping portion, so as to prevent the front end portion of the conductor from being deflected upwardly; and a notch provided adjacent to said bending portion so as to make it possible to confirm the clamping of the conductor by said conductor clamping portion.

2. The clamp-type terminal according to claim 1, wherein said conductor clamping portion comprises a pair of clamping piece portions formed respectively on opposite sides of said base portion, and said sheath clamping portion comprises another pair of clamping piece portions formed respectively on the opposite sides of said base portion.

3. The clamp-type terminal according to claim 1, a recess is formed in an inner surface of said conductor clamping portion.

* * * * *